US005414869A

United States Patent [19]

Thomson

[11] Patent Number: 5,414,869

[45] Date of Patent: May 16, 1995

[54] KNOTLESS SCARF AND METHOD OF MAKING SAME

[76] Inventor: Margaret I. Thomson, 11009 Peerless, Detroit, Mich. 48224

[21] Appl. No.: 158,691

[22] Filed: Nov. 26, 1993

[51] Int. Cl.[6] ..... A41D 23/00

[52] U.S. Cl. ..... 2/207; 2/243.1

[58] Field of Search ..... 2/207, 49.1, 50, 60, 2/88, 91, 129, 131, 133, 174, 208, 243.1, 103

[56] References Cited

U.S. PATENT DOCUMENTS

| | | | |
|---|---|---|---|
| D. 92,603 | 6/1934 | James | 2/207 |
| 783,173 | 2/1905 | Brown | 2/91 |
| 2,806,222 | 9/1957 | Carpenter | 2/207 |
| 3,466,665 | 9/1969 | Mooney | 2/207 |

OTHER PUBLICATIONS

Knotless Scarf Product Having Sewed Seams At The Top And Bottom Ends Thereof Dated Before Nov. 1992 to Applicant's Best Knowledge.

*Primary Examiner*—Clifford D. Crowder

*Assistant Examiner*—Gloria Hale

*Attorney, Agent, or Firm*—Peter D. Keefe

[57] ABSTRACT

A knotless scarf composed of a square piece of cloth material. The cloth material is provided with a first fold diagonally to form a triangle having two acutely angled corners. The cloth material is then provided with a second fold which brings together the acutely angled corners. A pattern is then placed thereover, and the cloth material is thereupon provided with a cut edge as delineated by the shape of the pattern. The cut edge includes a pair of neck segments. The cloth material is then unfolded along the second fold, wherein a neck segment is located on each side of the cloth material. The cut end of the cloth material is then sewed together, excepting the terminal end of each of the neck segments. The material is then turned inside out so that the sewing seam is hidden. Lastly, the two neck segments are sewed together to thereby form a narrowest portion of the scarf. The scarf so made is easily slipped over the head and worn comfortably about the neck. The narrowest portion may be worn fashionably in front, behind or to either side of the neck.

9 Claims, 2 Drawing Sheets

KNOTLESS SCARF AND METHOD OF MAKING SAME

BACKGROUND OF THE INVENTION

1. Field of the Invention

The present invention relates to scarfs, and more particularly to a scarf constructed without a knot.

2. Description of the Prior Art

Scarfs are popular because they are a beautiful clothing accessory which accents other clothes being worn. Conventionally, scarfs are constructed from a square piece of cloth that has been folded diagonally to form a triangle having two acute angled ends. The cloth is placed around the wearers neck and then the acute angled ends are mutually tied together to thereby form a conventional scarf having a knot.

Tying and arranging conventional scarves is time consuming and may he difficult for those suffering from a debilitation such as arthritis. Also, the knot is, itself, problematic regardless of how the conventional scarf is worn. If the knot is worn in front of the neck, it is unattractive and resembles a boy scout kerchief. If the knot is worn behind the neck, the knot causes wearing of a jacket to be uncomfortable. If the knot is worn to one or the other side of the neck, a pin must pierce the scarf in order to keep it securely in place.

Accordingly, what is needed in the art is an attractive scarf which is constructed without a knot.

SUMMARY OF THE INVENTION

The present invention is an attractive, knotless scarf.

The scarf according to the present invention is composed of a square piece of cloth material. The cloth material is provided with a first fold diagonally to form a triangle having two acutely angled corners. The cloth mate-rial is then provided with a second fold which brings together the acutely angled corners. A pattern is then placed thereover, and the cloth material is thereupon provided with a cut edge as delineated by the shape of the pattern. The cut edge includes a pair of neck segments. The cloth material is then unfolded along the second fold, wherein a neck segment is located on each side of the cloth material. The cut end of the cloth material is then sewed together, excepting the terminal end of each of the neck segments. The material is then turned inside out so that the sewing seam is hidden. Lastly, the two neck segments are sewed together to thereby form a narrowest portion of the scarf.

The scarf according to the present invention is easily slipped over the head and worn comfortably about the neck. The narrowest portion may be worn fashionably in front, behind or to either side of the neck.

Accordingly, it is an object of the present invention to provide a knotless scarf.

It is an additional object of the present invention to provide a knotless scarf having a predetermined shape which provides a fashionable appearance when worn.

It is a further object of the present invention to provide a knotless scarf having a predetermined shape which provides a fashionable appearance when worn, with the neck seam in front, behind or to either side of the neck.

These, and additional objects, advantages, features and benefits of the present invention will become apparent from the following specification.

DETAILED DESCRIPTION OF THE PREFERRED EMBODIMENT

Figure 1:
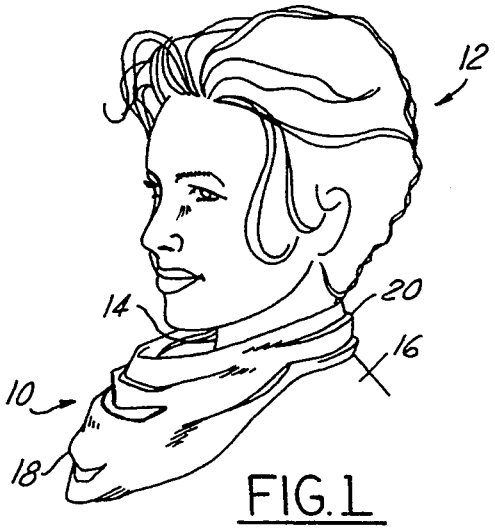
FIG. 1 is a perspective view of the scarf according to the present invention, shown in operation on a wear's neck.

The scarf 10 according to the present invention is provided without a knot and is worn fashionably as generally indicated, by way of preferred example, in FIG. 1. The scarf 10 is slipped over the wear's head 12 and then placed on the neck 14 at the shoulders 16. The scarf 10 has a preselected shape characterized by a wide width portion 18 which tapers to a narrow width portion 20. FIG. 1 depicts the wider width portion 18 placed at the front of the neck. However, the wider width portion 18 may be placed at the rear of the neck or at either side of the neck. In the case of placement at either side of the neck, the scarf may be held thereat by a decorative pin, preferably the scarf not being pierced but rather being placed .inside the two ends of the clasp of the pin.

The construction of the scarf 10 will now be detailed with reference being had additionally to FIGS. 2 through 12.

Figure 2:
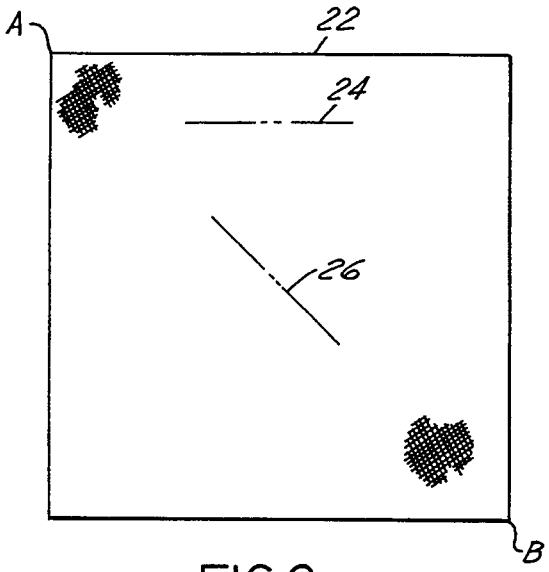
FIG. 2 is a plan view of a cloth material from which is formed the scarf depicted FIG. 1.
Figure 3:
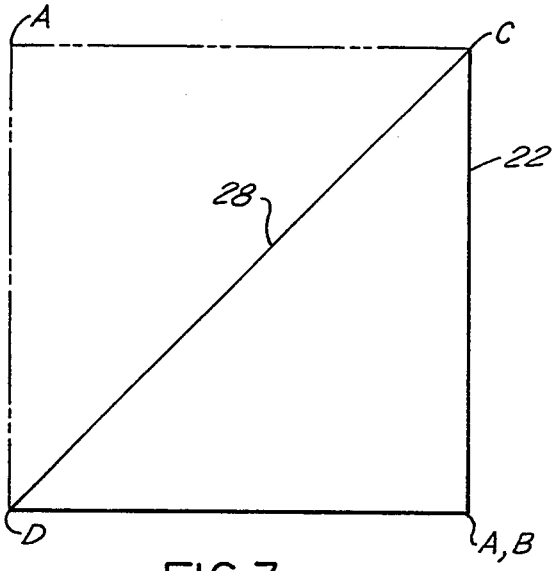
FIG. 3 is a plan view of the cloth material after being provided with a first fold.

As shown in FIG. 2, a square piece of preselected cloth material 22 is laid open on a flat surface. The direction of the straight grain 24 and of the bias 26 of the weave of the cloth material 22 are ascertained. The cloth material 22 is provided with a first fold 28, wherein it is folded along a diagonal which thereby forms a first triangular shape having a right angle A,B, as shown in FIG. 3. In this regard, one corner A is brought into alignment with an opposite corner B, wherein the bias 26 is oriented perpendicular with respect to the first fold 28. Folding with the bias 26 so oriented ensures that the cloth material 22 will fold flatly and the finished scarf 10 will have a most attractive appearance when worn. The first fold 28 now defines a top end of the cloth material 22.

Figure 4:
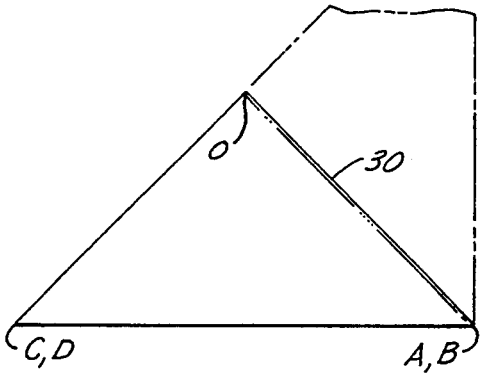
FIG. 4 is a plan view of a cloth material after being provided with a second fold.

The cloth material 22 is next provided with a second fold 30, wherein it is folded along a bisection of the right angle A,B which thereby forms a second triangular shape having a right angle apex corner O, as shown in FIG. 4. In this regard, one corner C is brought into alignment with an opposite corner D.

Figure 5:
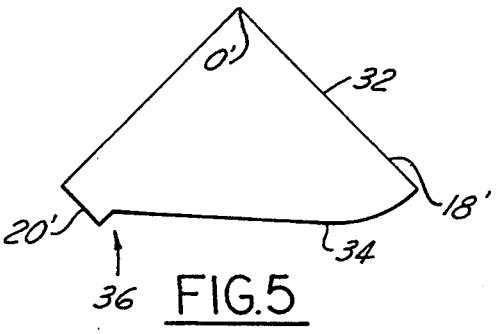
FIG. 5 is a plan view of a pattern.

A pattern 32 having a predetermined shape is now provided, as shown by way of example in FIG. 5. The pattern 32 has a right angle pattern apex corner O' which matches the apex corner O of the cloth material 22 after it has been provided with the second fold 30 (as shown in FIG. 4). The pattern 32 further has a guide edge 34 which is shaped to provide a template for cutting the cloth material 22 so as to provide a predetermined shape for the scarf 10. One end of the pattern 32 is a widest end 18' and the opposite end thereof is a narrowest end 20'. When construction of the scarf 10 is completed, the widest end 18' will correspond to the widest portion 18 of the scarf and the narrowest end 20' will correspond to the narrowest portion 20 of the scarf. The area 36 of the cloth material 22 immediately adjacent the narrowest end 20' is shaped to provide a pair of neck segments (see 44 in FIG. 8), the nature of which will become clear from the explanatory description presented hereinbelow.

Figure 6:
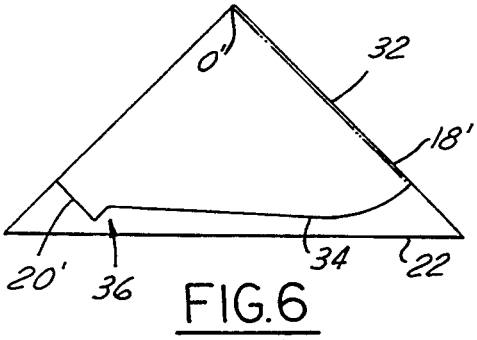
FIG. 6 is a plan view of the pattern alignably placed over the cloth material as folded in the depiction of FIG. 4.

The pattern 32 is now placed superimposingly over the cloth material 22, with the apex corners O, O' being aligned, as shown in FIG. 6. A mark M is now placed onto the cloth material 22 by tracing along the guide edge 34 of the pattern 32.

Figure 7:
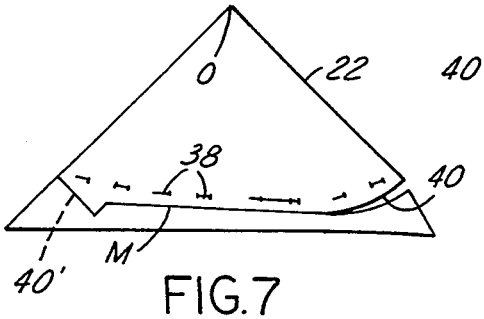
FIG. 7 is a plan view of the cloth being cut according to the shape of the pattern depicted in FIG. 5.

The pattern 32 is removed from the cloth material 22, and the cloth material is pinned by pins 38 adjacent the mark M on the side thereof closest to the apex corner O in order to prevent relative slippage of the layers of the cloth material. The cloth material 22 is now cut, such as with scissors, along the mark M, as shown in FIG. 7 to provide a first cut edge 40 and a second cut edge 40'. The pins 38 are thereupon removed.

Figure 8:
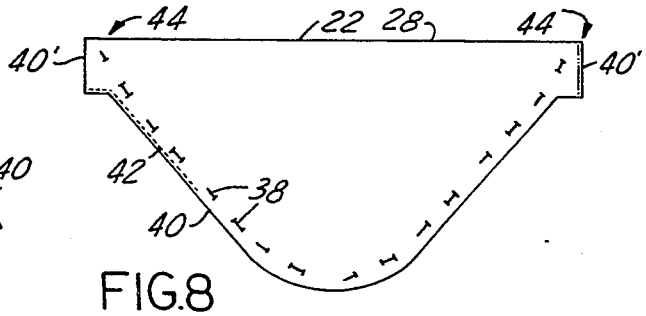
FIG. 8 is a plan view of the cloth material with the second fold now unfolded and the cut end thereof thereupon being sewn together.

The cloth material 22 is now unfolded along the second fold 30. The first fold 28 defines the aforementioned top end of the cloth material 22, while the first cut edge 40 defines a bottom end of the cloth material. The first fold 28 provides the cloth material with two layers. The pins 38 are placed along the first cut edge 40, as depicted in FIG. 8. Now, the two layers of the cloth material are sewn together by (preferably machine) stitching 42 along the first cut edge 40. The stitching 42 is not provided along the second cut edge 40' thereby resulting in the terminal ends 46 of the neck segments 44 being left open. The pins 38 are thereupon removed.

Figure 9:
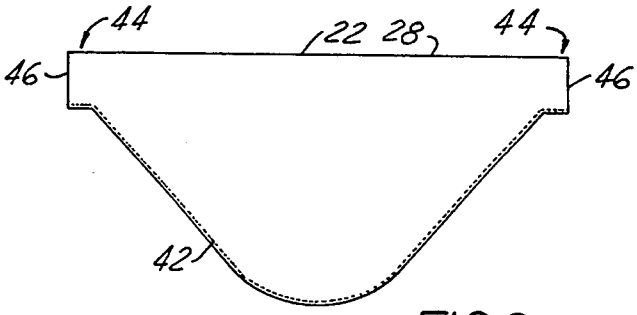
FIG. 9 is a plan view of the cloth material after having been turned inside out.

The cloth material 22 is now turned inside out, This task is accomplished by grasping a portion of the cloth material through an open terminal end 46 of a neck segment 44 and pulling the cloth material therethrough until the cloth material is turned inside out, as shown in FIG. 9.

Figure 10:
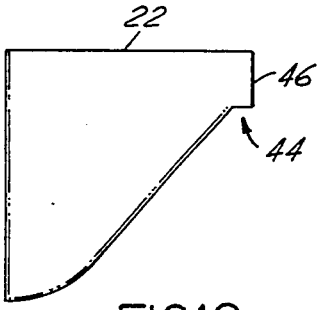
FIG. 10 is a plan view of the neck segments of the cloth material now being mutually aligned.
Figure 11:
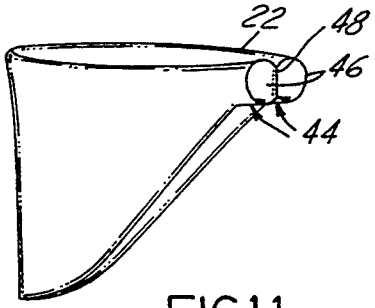
FIG. 11 is a perspective view of the neck segments of the cloth material being in part sewn together as surfaces thereof are progressively brought into abutment.

As shown in FIGS. 10 and 11, the terminal end 46 of each neck segment 44 is placed mutually side by side. The terminal ends 46 are then opened, as shown in FIG. 11. Thereupon, the two abutting neck segments 44 are (machine) sewn together by a stitch 48 placed approximately one-half inch away from the terminal ends 46, as surfaces thereof are progressively brought into abutment. All but a final approximately one inch section is sewn (due to machine sewing limitations). In this regard, the two layers of the cloth material of each of the neck segments are not mutually sewn together.

Figure 12:
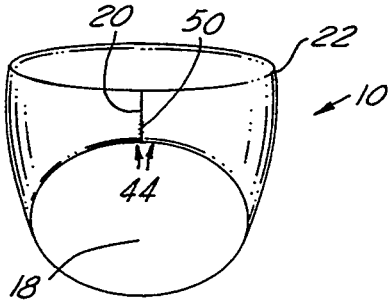
FIG. 12 is a perspective view of the cloth material with the neck segments being provided with a blind stitch to complete the sewing of the open ends and thereby form the scarf depicted in FIG. 1.

Finally, the remaining one inch segment is hand stitched using a blind stitch 50 to fully join the two neck segments 44. The two neck segments 44 are then mutually pulled apart to shapingly form the scarf 10, as depicted in FIG. 12. The scarf 10 is now worn as recounted hereinabove and as shown by way of preferred example in FIG. 1.

To those skilled in the art to which this invention appertains, the above described preferred embodiment may be subject to change or modification. Such change of modification can be carried out without departing from the scope of the invention, which is intended to be limited only by the scope of the appended claims.

What is claimed is:

1. A knotless scarf, comprising:

a cloth material having a top end; a bottom end of predetermined shape; and a pair of neck segments, one neck segment being respectively located at either side of said top end and situated between said top end and said bottom end;

wherein a first fold in said cloth material is located at said top end thereby providing two layers of said cloth material, said two layers of said cloth material being sewn together along said bottom end; and wherein said pair of neck segments are mutually sewn together without sewing together said two layers of said cloth material of each said neck segment;

wherein said scarf is characterized by a widest portion extending between said top end and said bottom end and a narrowest portion extending between said top end and said bottom end, said narrowest portion being located opposite said widest portion; wherein further said pair of neck segments are sewn together at said narrowest portion; and wherein said cloth material has a bias, wherein further said first fold is oriented perpendicularly with respect to said bias.

2. The knotless scarf of claim 1, wherein said top end is substantially straight and said bottom end has a predetermined tapered shape.

3. A method for making a knotless scarf comprising the steps of:

providing a piece of substantially square cloth material;

first folding the cloth material along a diagonal thereof, said step of first folding providing said cloth material with a first triangular shape having a right angle corner;

second folding the cloth material along a bisection of a right angle corner formed by said step of first folding, said step of second folding providing said cloth material with a second triangular shape having an apex corner;

providing a pattern of predetermined shape, the pattern having a guide edge and a pattern apex corner;

placing said pattern superimposingly over said cloth material after said step of second folding, said step of placing further comprising aligning the pattern apex corner with the apex corner of the cloth material;

cutting the cloth material along the guide edge to thereby provide a cut edge in the cloth material;

unfolding the cloth material to thereby remove the fold formed by said step of second folding, said step of unfolding resulting in the cloth material having a top end, a bottom end defined by said cut edge, and a pair of neck segments, one neck segment being located at each side of said top end and situated between said top end and said bottom end, each neck segment having a terminal end, said top end having a fold provided by said step of first folding, said fold providing two layers of said cloth material;

sewing together the two layers of cloth material along said cut end at said bottom end thereof;

turning said cloth material inside out; and sewing mutually together said neck segments adjacent said terminal ends thereof without sewing mutually together said two layers of cloth material of each said neck segment.

4. A scarf made according to the method of claim 3.

5. The method of providing a knotless scarf according to claim 3, further comprising determining the orientation of the bias of the cloth material; wherein said step of first folding provides said fold at an orientation perpendicular to said bias.

6. A scarf made according to the method of claim 5.

7. The method of providing a knotless scarf according to claim 5, wherein said step of placing further comprises placing a mark on said cloth material along the guide edge of the pattern; and removing thereupon the pattern from the cloth material; further wherein said step of cutting is performed by cutting along said mark.

8. The method of providing a knotless scarf according to claim 7, wherein said second step of sewing further comprises providing a stitch by machine and a blind stitch by hand.

9. A scarf made according to the method of claim 8.

* * * * *